US005878947A

United States Patent [19]

Hoy et al.

[11] Patent Number: 5,878,947

[45] Date of Patent: Mar. 9, 1999

[54] MULTIPLE ARTICLE BEVERAGE PACKAGE

[76] Inventors: Richard W. Hoy, 4443 N. Prospect Ave., Shorewood, Wis. 53211; Robert C. Gohsman, 500 W. Bradley Rd., Fox Point, Wis. 53217

[21] Appl. No.: 878,710

[22] Filed: Jun. 19, 1997

[51] Int. Cl.[6] ..... B65D 5/72; A47F 1/12

[52] U.S. Cl. ..... 229/182.1; 221/305; 229/104

[58] Field of Search ..... 229/104, 122.1; 206/427; 221/285, 288, 302, 305

[56] References Cited

U.S. PATENT DOCUMENTS

| | | | |
|---|---|---|---|
| 3,265,283 | 8/1966 | Farquhar | 229/122.1 |
| 3,356,279 | 12/1967 | Root | 299/122.1 |
| 4,739,920 | 4/1988 | Zimmermmann | 229/122.1 |
| 5,289,943 | 3/1994 | Powell | 229/104 |
| 5,482,185 | 1/1996 | McNaughton | 229/122.1 |

FOREIGN PATENT DOCUMENTS

| | | | |
|---|---|---|---|
| 668603 | 8/1963 | Canada | 229/122.1 |

*Primary Examiner*—Gary E. Elkins
*Attorney, Agent, or Firm*—Foley & Lardner

[57] ABSTRACT

A one piece multiple article beverage package having a bottom panel, a pair of side panels hingedly connected to the bottom panel and a pair of top panels hingedly connected to the top of each of the side panels, an end closure flap structure connected to each end of the side panels, and a tear out can dispensing tray formed on one end of the package, the tray is torn out of a portion of the side panels and a portion of the closure flaps and the bottom end closure flap, a triangular stop formed by a center strip hingedly connected to the bottom panel and a pair of side strips interconnected at the outer ends to form a triangular brace at the outer end of the tray.

6 Claims, 4 Drawing Sheets

MULTIPLE ARTICLE BEVERAGE PACKAGE

FIELD OF THE INVENTION

The present invention relates to improved multiple article paperboard packages and more importantly to an improved one piece can-type package carrier designed to dispense cans one at a time from a twelve pack as shown in the preferred embodiment.

BACKGROUND OF THE INVENTION

It is known in the art of beverage carrier packages to provide a package having a bottom panel, a pair of side panels and a top panel, all hingedly attached together with a handle formed in the top panel of the carrier and with end closure flaps being formed on each end of the carrier. The end closure flaps may be locked together by locking and latching flaps as shown in U.S. Pat. No. 4,396,143, issued on Aug. 2, 1983.

It is also known to provide dispensing features in packages such as beforementioned which are designed to be torn out at the end closure flaps of the package and partly out of the sides of the package so that one can may be removed from the package at a time. Since the package contains several cylindrical shaped cans stacked on top of each other within the package it is foreseeable that when the tear out dispensing feature is torn out of the package, that more than one can would tend to roll out of the package unless some means were used to retain them in the package.

In U.S. Pat. No. 3,894,681, issued Jul. 15, 1975, there are provided downwardly depending tabs formed by a tear out panel in the end closure flap to retain the cans in the package. The cans are removed one at a time by pulling the can through the tabs. Such a retaining means, while sufficient for an end closure flap type carton as typified in the cited reference would not necessarily be satisfactory for the Applicant's type of package. In this regard after removal of several cans in the package of the type shown in the cited reference, the downwardly depending tabs can be bent outwardly and thereby lose their holding ability for the remainder of the cans in the package.

SUMMARY OF THE PRESENT INVENTION

In order to overcome the beforementioned problems inherent in the cited references, there is provided by the present invention an improved multiple article beverage package for cans and the like designed to retain the cans in a glued package. In this regard the package has an improved retaining means formed by tear out sections at one end of the package which provide a stop outwardly of the package to more positively retain the cans until removed one at a time. The Applicant's tear out dispensing feature is formed on one end of the package and has end closure flaps adhesively secured together so that the bottom closure flap is positioned adjacent the side closure flaps and is adhesively secured thereto to provide a tray feature which is hingedly pivoted outwardly when the tear out can dispensing feature is opened. The retaining means is formed on the package to retain one can at a time, which can be retained outwardly of the package and removed allowing a second can to roll out of the package. The retaining means comprises a flap which is formed out of the bottom flap and a portion of the side wall panels.

Accordingly, the object and advantage of the invention is to provide a new and novel improved multiple article beverage package having a new and improved tear out dispensing feature formed by the closure flaps of the package and having a tear out strip on the bottom of the package which can be rolled up to elevate the back of the package which allows the cans in the package to roll out onto the porch so that they can be quickly and easily picked up from the porch.

Other principal features and advantages of the invention will become apparent to those skilled in the art upon review of the following drawings, the detailed description and the appended claims.

Figure 1:
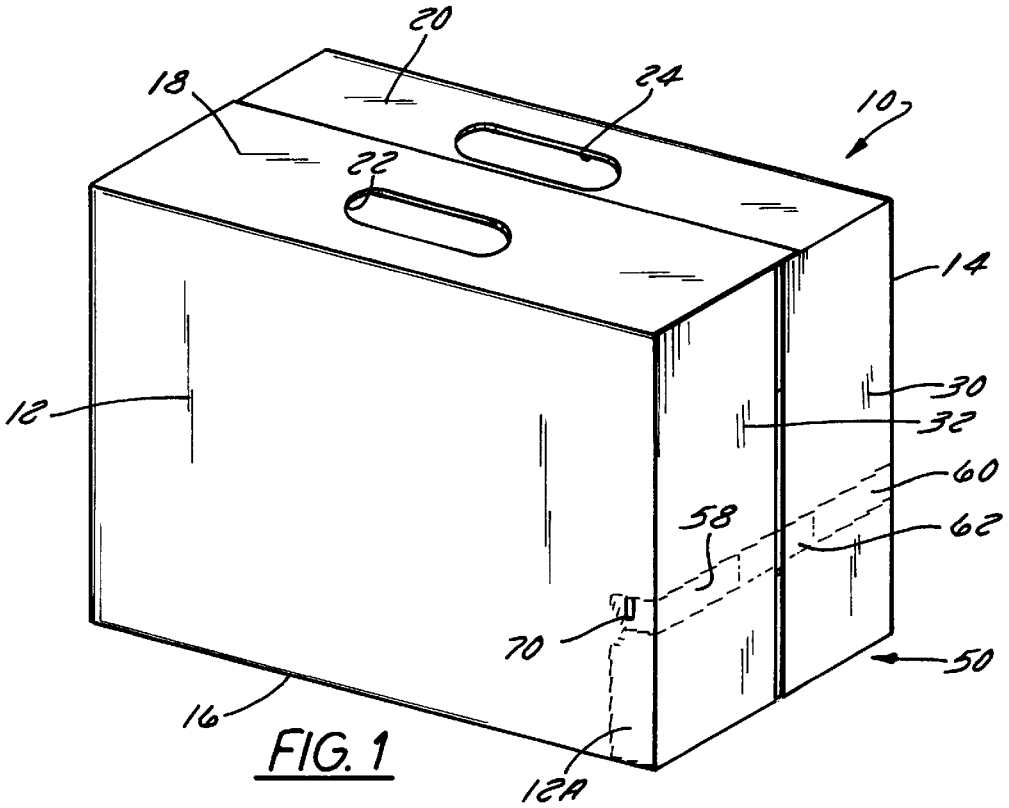
FIG. 1 is a perspective view of the improved multiple article beverage package showing the package completely erected and glued together as it would appear in a retail outlet.

Before explaining at least one embodiment of the invention in detail it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

Referring to FIGS. 1, 2, 3 and 4 a new and improved multiple article beverage container or package is shown generally by the numeral 10. The package is formed from a single strip of cardboard and generally includes a pair of side panels 12 and 14 hingedly attached to a bottom panel 16. Top panels 18 and 20 are also hingedly attached to the side panels 12 and 14, respectively. The two top panels 18 and 20 overlap and are fixedly attached together by an adhesive as is known in the art. The top panels 18 and 20 have formed therein handle openings 22 and 24 for carrying the package as known in the art.

Each end of the package contains an end closure flap structure shown generally by the numerals 28, 38 and 34, 44. The flaps 28 and 38 are formed on each end of the panel 20. The flaps 34 and 44 are hingedly attached to each end of the panel 18.

End closure flaps 32 and 42 are provided on each end of the side panel 12. End closure flaps are provided on each end of the bottom panel 16. End closure flaps 40 and 30 are provided on each end of side panel 14. On assembly the end flaps 34, 38 and 28 are folded inwardly and overlapped by side panels 30 and 32. End flaps 44, 48 and 38 are also folded inwardly and overlapped by side panels 40 and 42.

Formed on the bottom portion of one end of the package is a tear out, downwardly hinged, can dispenser tray shown generally by the numeral 50 which is formed on one end of the bottom panel 16. The tray 50 is designed to be torn out of a portion of the side panels 12 and 14 and a portion of the left and right end closure flaps 30 and 32. The tray is folded downwardly to expose an immediately adjacent can 52 contained within the package 10. As has been beforementioned the bottom end closure flap 38 is adhesively secured to the torn out portions 30A and 32A of the end closure flap 30 and the end closure flap 32. A stop 56 is formed on the end of the flap 38 by means of strips 58 and 60 which comprise an upwardly positioned retaining flap 62 formed on the edge of the end wall flap 38 and having strips 58 and 60 folded outwardly and interlocked by slots 68 and 70 to form a V shaped stop at the end of the panel 38.

Figure 2:
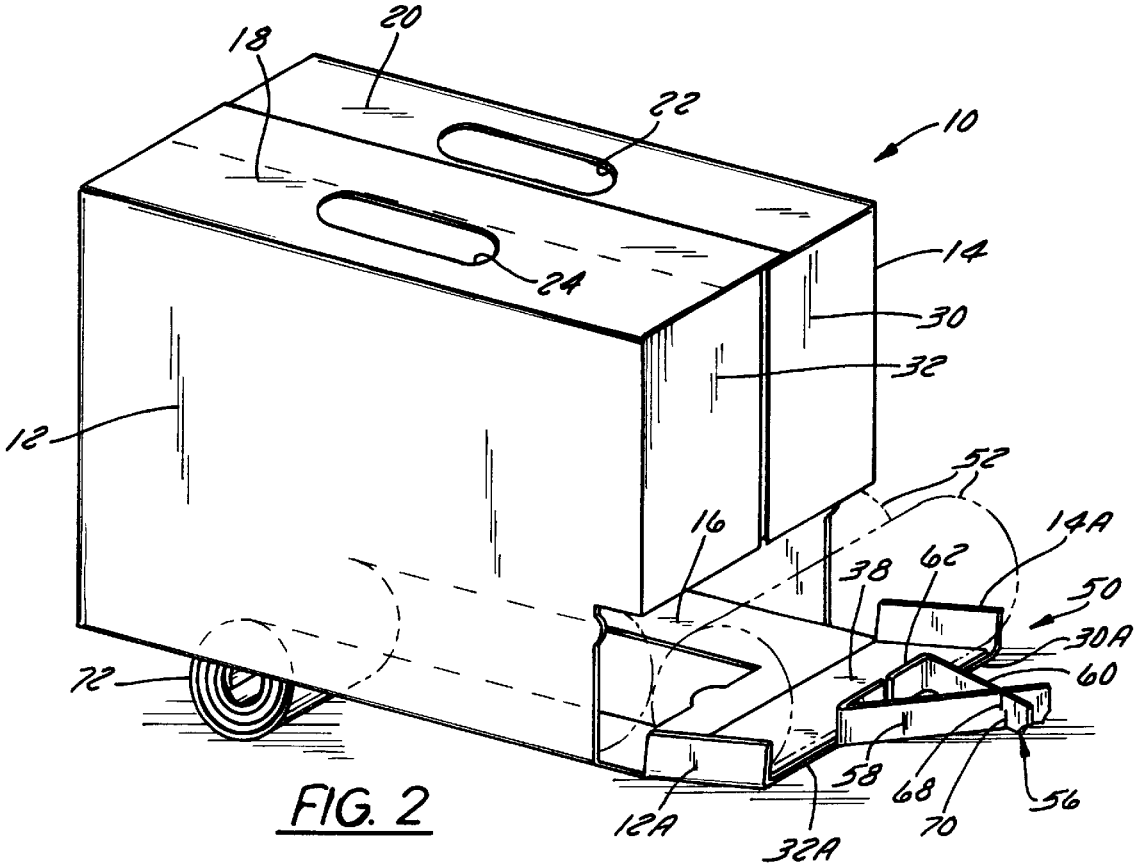
FIG. 2 is a view similar to FIG. 1 showing the new and improved tear out section dispensing flap feature of the Applicant's invention and also showing the retaining means provided at the end of the flap to retain the cans on the flap.
Figure 3:
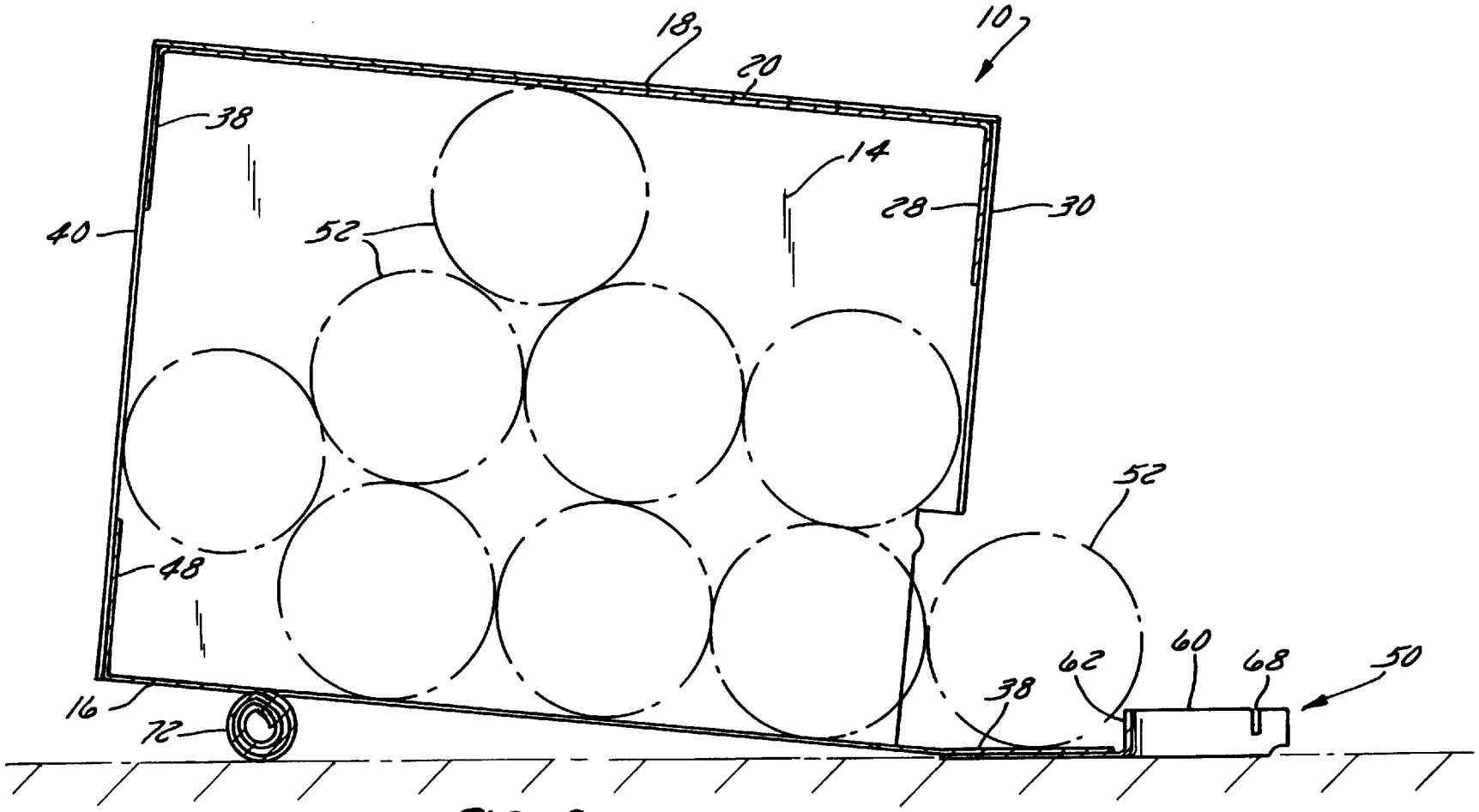
FIG. 3 is a side elevation view showing the retainer elevated for dispensing cans.
Figure 4:
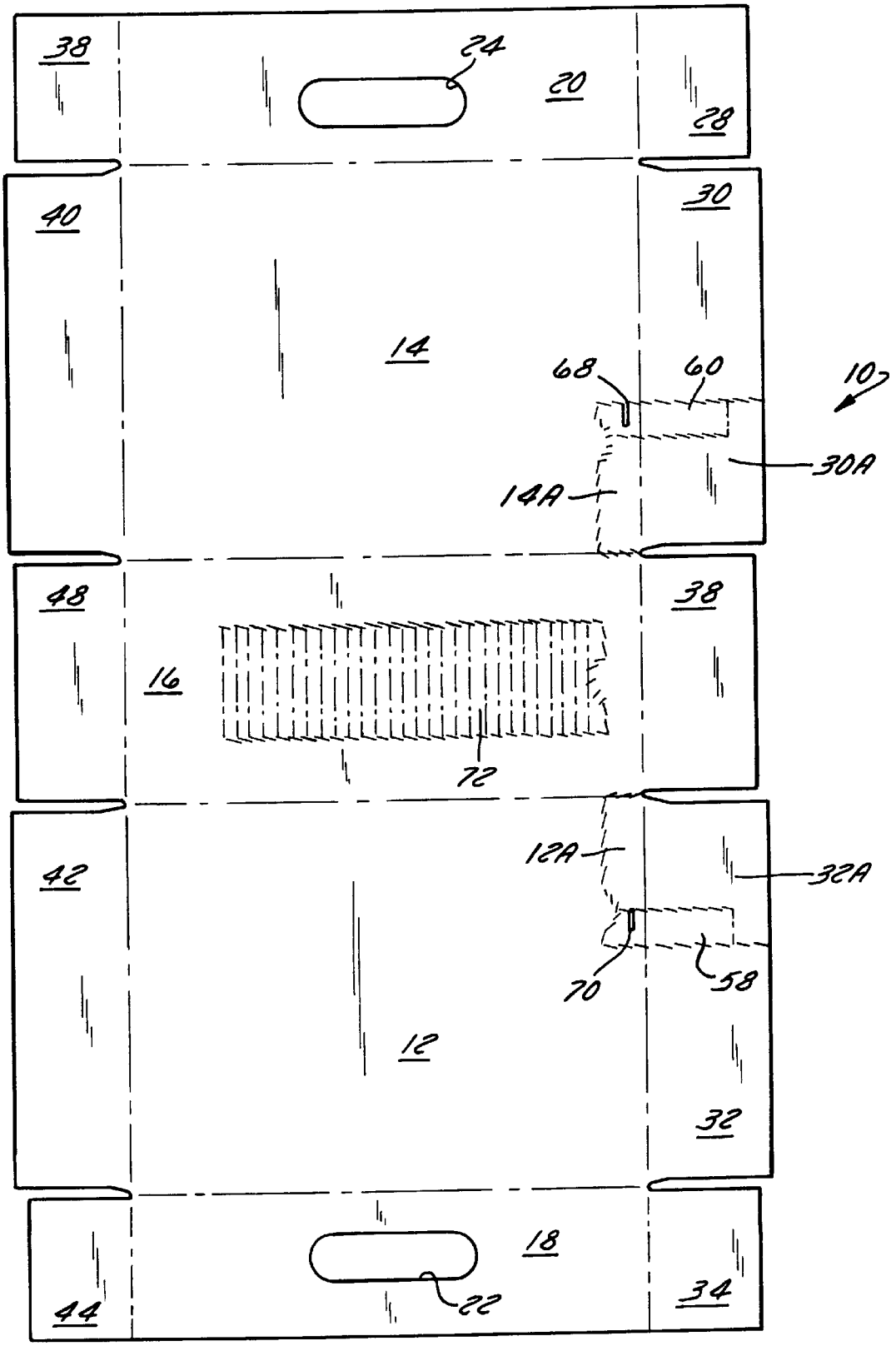
FIG. 4 is a plan view of the production blank of the beverage package shown in FIGS. 1 and 2.
Figure 5:
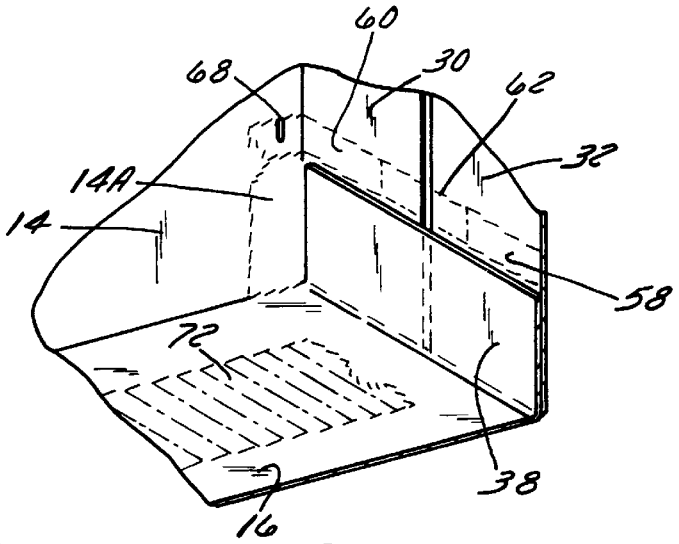
FIG. 5 is a perspective view of the roll out tear section for elevating one end of the container.
Figure 6:
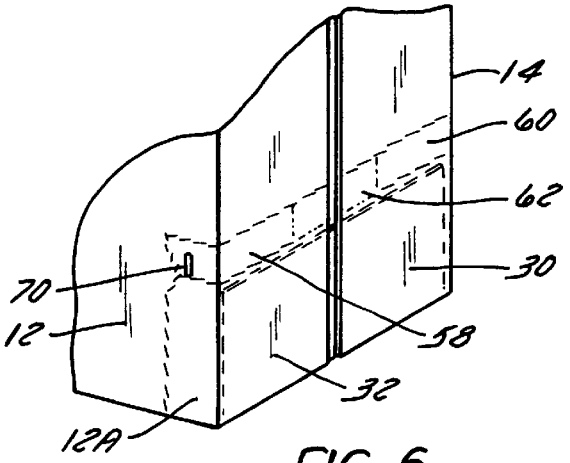
FIG. 6 is a perspective view of the tear out support section of the container.
Figure 7:
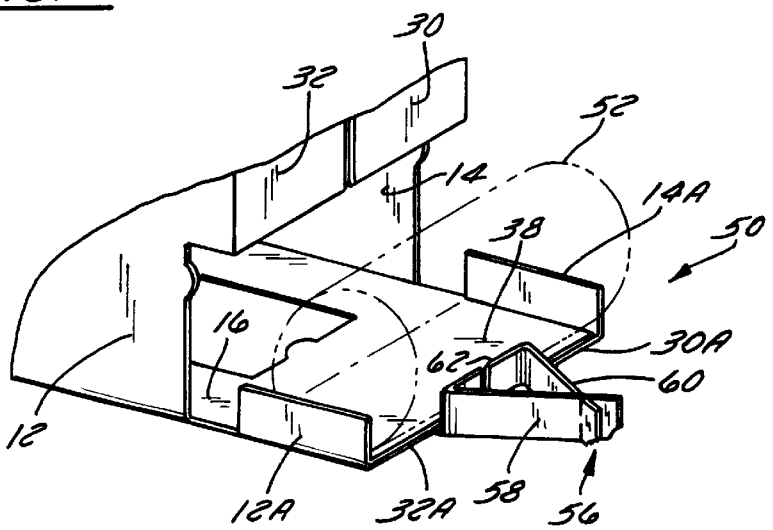
FIG. 7 is a perspective view of the tear out section with the triangular stop tab formed on the outer edge of the tear out section.

In order to force the cans to roll out on the flap 38 a strip 72 is die cut out of the bottom panel 16 and rolled rearwardly from the dispensing opening formed in the end of the container and interlocked to the opposite end of the bottom of the container as shown in FIGS. 2 and 3, with the opposite end of the container elevated to provide an inclined ramp which allows the cans to roll outwardly from the carton onto the tray 50.

Thus, it should be apparent that there has been provided in accordance with the present invention a multiple article beverage package that fully satisfies the objectives and advantages set forth above. Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

The embodiments of the invention in which an exclusive property or privilege is claimed are defined as follows:

1. A one piece multiple article beverage package for cans and the like and of the type having a bottom panel, a pair of side panels hingedly attached to the bottom panel, a top handle structure hingedly attached to each of the side panels, an end closure flap structure formed on each end of the package and hingedly attached to the side panels and the top panel and the bottom panel and fixedly attached together, each end closure flap structure comprising a top flap and a bottom flap and left and right end closure flaps, the improvement comprising:

an end closure flap structure on at least one end of the package being adhesively secured together so that at least the bottom end closure flap is positioned adjacent the left and right end closure flaps and is adhesively secured thereto;

a tear out, downwardly hinged, can dispensing tray formed on one end of the package and being designed to be torn out of a portion of the side panels and a portion of the left and right end closure flaps, the bottom end closure flap being adhesively secured to the torn out portions of the left and right end closure flaps and serving as a tray upon which the cans may roll out one can at a time from the package; and means formed on the package for retaining cans in the package after the tear out dispenser has been opened so that one can may be removed at a time without the remaining cans being forced out of the package from the weight of the successive cans placed on top of each other within the package, the retaining means including an upwardly positioned retaining flap formed partially out of the bottom end closure flap and partially out of a portion of the side panels.

2. The beverage package according to claim 1 wherein said retaining means comprises a triangular stop formed by a center strip hingedly connected to the bottom closure flap and a pair of flaps hingedly connected to the center strip and interconnected at their outer ends to form a triangular brace for the center strip.

3. The beverage package according to claim 2 including means formed from the bottom panel for elevating the end of the container opposite the triangular stop to allow the cans to roll down the bottom panel onto the tray.

4. A one piece multiple article beverage package for cans and the like, and of the type having a bottom panel, a pair of side panels hingedly connected to the bottom panel, and a pair of top panels hingedly connected to each of the side panels, the package also having an end closure flap structure formed on each end of the package, comprising:

a tear out, downwardly hinged can dispensing tray formed on one end of the package and designed to be torn out of a portion of the side panels and a portion of the left and right end closure flaps, the bottom end closure flap being secured to the torn out portions of the right and left end closure flaps, and serving as a tray upon which the cans may roll out of the package one can at a time, and means formed on the opposite end of the bottom panel for elevating the opposite end of the container to allow the cans to roll out onto the tray.

5. The beverage package according to claim 4 including a triangular stop formed by a center strip hingedly connected to the bottom panel and having a strip hingedly connected to each end of the center strip and interconnected at their outer ends to form a triangular brace for the center strip.

6. A multiple article beverage package for cans or the like and of the type having a bottom panel, a pair of side panels hingedly attached to the bottom panel, a top panel structure hingedly attached to the side panels, the top panel structure having formed thereon handle means for carrying the package, the package also having an end closure flap structure formed on each end of the package and hingedly attached to the side panels and the top panel structure and the bottom panel and fixedly attached together, each end closure flap structure comprising a top flap and a bottom end closure flap and left and right end closure flaps, the improvement comprising the end closure flap structure on at least one side of the package being adhesively secured together so that at least the bottom end closure flap is positioned adjacent the left and right end closure flaps and is adhesively secured thereto;

the tear out, downwardly hinged, can dispensing tray feature being formed on the one side of the package and being designed to be torn out of a portion of the side panels and a portion of the left and right end closure flaps, the bottom end closure flap being adhesively secured to the torn out portions of the left and right end closure flaps and serving as a tray upon which the cans may roll over when removing them one at a time from the package and means formed on the package for retaining the cans in the package after the tear out dispenser feature has been opened so that one can may be removed at a time without the remaining cans being forced out of the package from the weight of the successive cans placed on top of each other within the package, the retaining means comprising an upwardly positioned retaining flap formed partially out of the bottom end closure flap and partially out of a portion of the bottom panel.

* * * * *